US011988067B1

(12) United States Patent
Decuir et al.

(10) Patent No.: US 11,988,067 B1
(45) Date of Patent: May 21, 2024

(54) FRANGIBLE DISK SUB, METHOD AND SYSTEM

(71) Applicant: Baker Hughes Oilfield Operations LLC, Houston, TX (US)

(72) Inventors: Brandon Decuir, Houston, TX (US); Donavan Holland Brown, Houston, TX (US); Nicholas S. Conner, Cypress, TX (US); Edward J. Kossa, Huffman, TX (US); Frank Maenza, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/160,617

(22) Filed: Jan. 27, 2023

(51) Int. Cl.
*E21B 34/06* (2006.01)
*E21B 33/12* (2006.01)
*E21B 34/14* (2006.01)

(52) U.S. Cl.
CPC ..... *E21B 34/063* (2013.01); *E21B 34/14* (2013.01)

(58) Field of Classification Search
None
See application file for complete search history.

(56) References Cited

U.S. PATENT DOCUMENTS

| | | | | |
|---|---|---|---|---|
| 1,133,299 | A * | 3/1915 | Name not available | B65D 9/34 217/17 |
| 8,322,448 | B2 * | 12/2012 | Brandsdal | E21B 34/063 166/376 |
| 10,655,413 | B2 * | 5/2020 | Brandsdal | E21B 34/063 |
| 11,149,522 | B2 * | 10/2021 | Brandsdal | E21B 33/1208 |
| 11,162,325 | B2 * | 11/2021 | Tunes | E21B 34/10 |
| 11,332,999 | B1 * | 5/2022 | Eriksen | E21B 33/1208 |
| 11,441,382 | B1 * | 9/2022 | Eriksen | E21B 34/102 |
| 2014/0008085 | A1 * | 1/2014 | Tinnen | E21B 33/134 166/134 |
| 2016/0060998 | A1 * | 3/2016 | Hiorth | E21B 33/1208 166/192 |
| 2016/0281455 | A1 * | 9/2016 | Brandsdal | E21B 33/12 |
| 2017/0022783 | A1 * | 1/2017 | Yong | E21B 34/10 |
| 2019/0017345 | A1 * | 1/2019 | Brandsdal | E21B 34/063 |
| 2019/0352995 | A1 * | 11/2019 | Giroux | E21B 47/06 |

* cited by examiner

*Primary Examiner* — Matthew Troutman
*Assistant Examiner* — Douglas S Wood
(74) *Attorney, Agent, or Firm* — CANTOR COLBURN LLP

(57) ABSTRACT

A frangible disk sub includes a housing, a carrier movably disposed in the housing, and a frangible disk sealedly disposed in the carrier. The sub further includes a breaker concealed within a breaker housing and a breaker housing movement inhibitor. A method includes pressuring the disk to exceed a threshold pressure, moving the disk, carrier and breaker mechanism relative to the housing. The method further includes causing the breaker to contact the stop, exposing a hard point of the breaker, and driving the disk into the hard point.

20 Claims, 4 Drawing Sheets

FRANGIBLE DISK SUB, METHOD AND SYSTEM

BACKGROUND

In the resource recovery and fluid sequestration industries, there is often need for a temporary barrier that provides pressure integrity up to a known threshold pressure and thereafter to allow fluid passage. Frangible disks have been used for such duty to adequate effect, but they suffer from requiring excessive pressure to rupture that may impact other operations or tax pumps, etc. The art would well receive alternatives that avoid these drawbacks.

SUMMARY

An embodiment of a frangible disc sub including a sub housing, a disk carrier movably disposed in the housing, a frangible disk sealedly disposed in the carrier, a breaker mechanism movably disposed in the sub housing from an inactive position to an active position, the breaker mechanism including a breaker housing movable within the sub housing, and a breaker concealed within the breaker housing, and a breaker housing movement inhibitor disposed to inhibit movement of the breaker mechanism relative to the housing.

An embodiment of a method for rupturing a frangible disk in a disk sub including pressuring the disk to exceed a threshold pressure, moving the disk, carrier and breaker mechanism relative to the housing, causing the breaker to contact the stop, exposing a hard point of the breaker, and driving the disk into the hard point.

An embodiment of a borehole system including a borehole in a subsurface formation, a string in the borehole, and a frangible disk sub disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
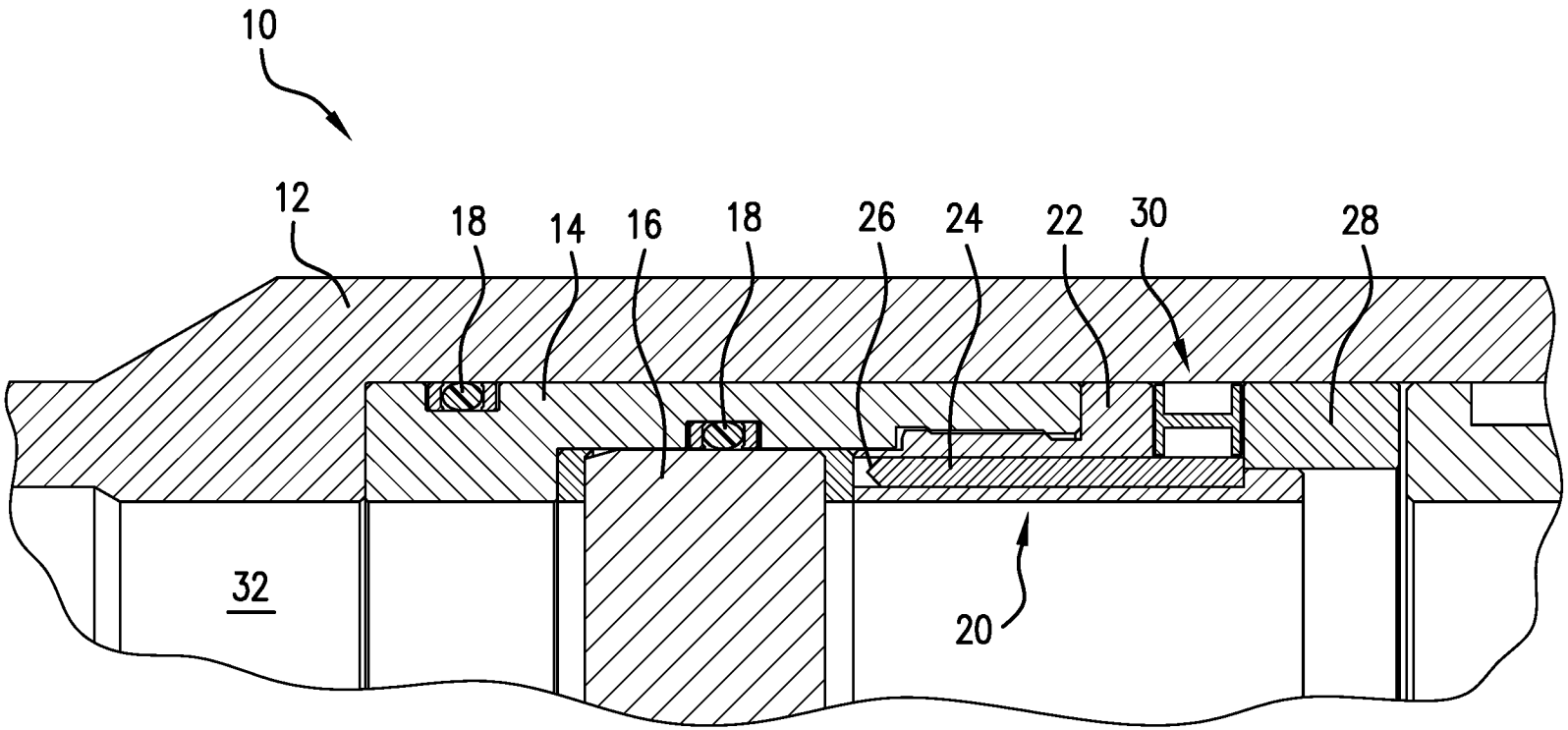
FIG. 1 is a section view of a frangible disk sub as disclosed herein.

Referring to FIG. 1, a frangible disc sub 10 is illustrated. The sub 10 includes a sub housing 12. A disk carrier 14 is movably disposed in the housing 12 with a seal 18. The disk carrier 14 supports a frangible disk 16 that is sealed in the carrier 14 with a seal 18. The seal may be, for example an o-ring. A breaker mechanism 20 is also within the housing 12 and is movable with the carrier 14. The mechanism 20 comprises a breaker housing 22 movably disposed in the sub housing 12 and a breaker 24 movably disposed in the breaker housing 22. The breaker 24 is movable in the breaker housing 22 from an inactive position (wherein a hard point 26 is unexposed from the breaker housing 22) to an active position (wherein the hard point 26 is exposed from the breaker housing 22). The breaker 24 is movable to the active position based upon a contact of the breaker 24 with a stop 28 that is a part of the sub housing 12 or another sleeve that is backed up by the housing 12 and is, in any event, immovable relative to the housing 12. Prior to an operation that is intended to rupture the disk 16 a breaker housing movement inhibitor 30 is disposed to inhibit movement of the breaker mechanism 20 relative to the housing 12. In the embodiment of FIG. 1, the inhibitor 30 is a crush ring that may in one construction have an H shaped cross section. The inhibitor is positioned against the stop 28 in the unactuated position.

When rupture of the disk 16 is desired, pressure within the housing 12 upstream of the disk 16 (area 32) is raised to exceed a threshold pressure (which may be set during manufacture to whatever threshold is desired). Upon exceeding the threshold pressure, load on the inhibitor 30 causes the mechanical failure of the inhibitor. The inhibitor collapses and allows movement of the carrier 24, disk 16 and mechanism 20 to the right of FIG. 1. Because of the stop 28, the breaker 24 may not move toward the right of the figure and hence the carrier 14, disk 16 and mechanism 20 (minus the breaker 24) will move while the breaker 24 remains stationary. This exposes a hard point 26 of the breaker 24 outside of the breaker housing. With the hard point 26 exposed, the disk 16 may come into loaded contact with the hard point 26 causing rupture of the disk 16. The contact may be an impact or may be a smooth dynamic loading, with impact creating a more definitive and rapid rupture of the disk 16.

Figure 2:
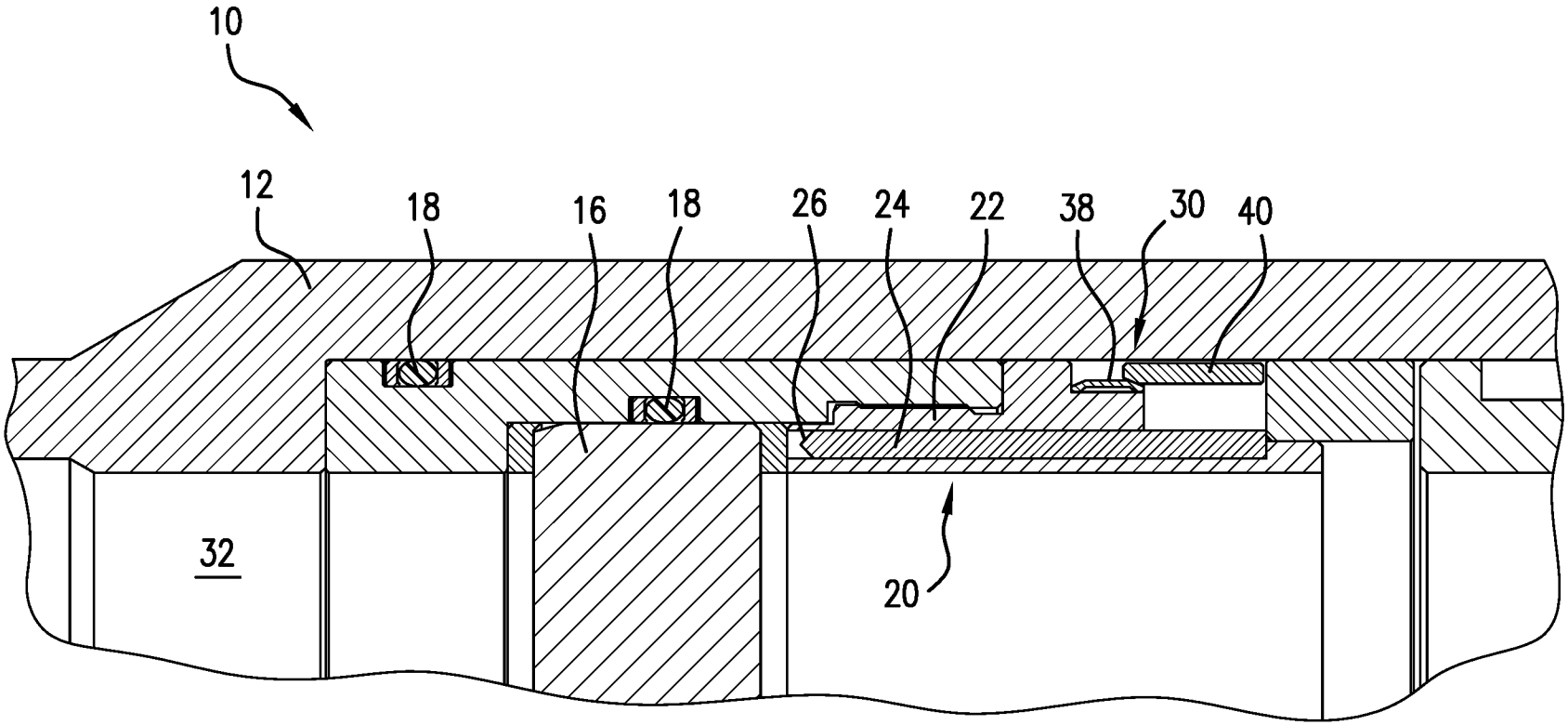
FIG. 2 is a section view of an alternate embodiment of a frangible disk sub as disclosed herein.

Referring to FIG. 2, It should be appreciated that many of the features of the sub 10 are the same as in the FIG. 1 embodiment. Numerals will remain the same for substantially similar components. Focus will instead be drawn to the inhibitor 30, which in the embodiment of FIG. 2, is distinct. In the FIG. 2 embodiment, the breaker housing 22 also supports a biaser 38 that is interactive with a sleeve 40. The sleeve 40 abuts the stop 28 and hence is immobile with respect to the housing 12. For the breaker 24 to expose the hard point 26 as in the previous embodiment, the breaker housing 22 must move relative to the breaker 24. To do this in the embodiment of FIG. 2, the sleeve 40 must be caused to compress the biaser 38 and allow movement of the breaker housing 22. Substantial friction is created in this arrangement and is based upon the spring constant of the biaser and the frictional coefficient of the sleeve to biaser interface. The particular coefficient of friction desired may be selected during manufacture. These parameters dictate the threshold pressure required in area 32 in order to rupture the disk 16. In other respects the two embodiments work in the same way.

Figure 3:
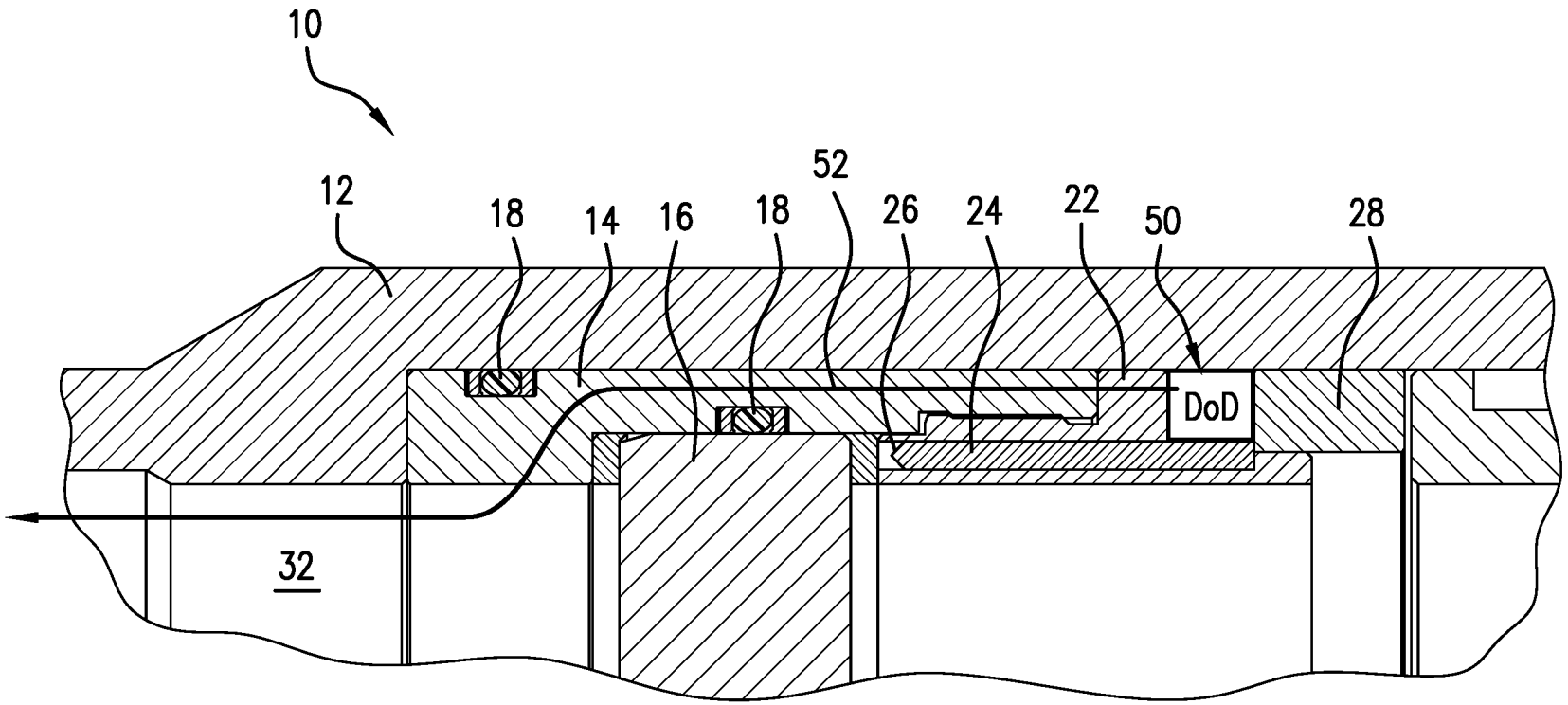
FIG. 3 is a section view of another alternate embodiment of a frangible disk sub as disclosed herein.

Referring to FIG. 3, another alternate embodiment of a frangible disc sub 10 is illustrated. As in the previously described embodiment of FIG. 2, many of the features of the sub 10 are the same as in the FIG. 1 embodiment. Numerals will remain the same for substantially similar components. Focus will instead be drawn to the inhibitor 50, which in the embodiment of FIG. 3, is distinct. Inhibitor 50 abuts the stop 28 and the breaker housing 22, preventing the breaker housing 22 from moving toward the stop 28 and thereby exposing the hard point 26. The inhibitor 50 is a disappear-on-demand or degrade-on-demand (d-o-d) material that is responsive to a signal received therein to immediately begin to degrade to a lesser volume, or disintegrate, or to disappear.

A d-o-d material comprises a matrix material including an energetic material configured to generate energy upon activation to facilitate the disintegration of the disintegrable article. The matrix material comprises a polymer, a metal, a composite, or a combination comprising at least one of the foregoing, which provides the general material properties such as strength, ductility, hardness, density for tool functions.

Optionally, the matrix material further comprises additives such as carbides, nitrides, oxides, precipitates, dispersoids, glasses, carbons, or the like in order to control the mechanical strength and density of the disintegrable article.

The energetic material may comprise a thermite, a reactive multi-layer foil, an energetic polymer, or a combination comprising at least one of the foregoing. Use of energetic materials disclosed herein is advantageous as these energetic materials are stable at wellbore temperatures but produce an extremely intense exothermic reaction following activation, which facilitates the rapid disintegration (disappearance) of the disintegrable articles.

Thermite compositions can include, for example, a metal powder (a reducing agent) and a metal oxide (an oxidizing agent) that produces an exothermic oxidation-reduction reaction known as a thermite reaction. Choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide, and combinations including at least one of the foregoing, for example.

Energetic polymers are materials possessing reactive groups, which are capable of absorbing and dissipating energy. During the activation of energetic polymers, energy absorbed by the energetic polymers cause the reactive groups on the energetic polymers, such as azido and nitro groups, to decompose releasing gas along with the dissipation of absorbed energy and/or the dissipation of the energy generated by the decomposition of the active groups. The heat and gas released promote the disintegration of the di sintegrable inhibitor 50.

Energetic polymers include polymers with azide, nitro, nitrate, nitroso, nitramine, oxetane, triazole, or tetrazole containing groups. Polymers or co-polymers containing other energetic nitrogen containing groups can also be used. Optionally, the energetic polymers further include fluoro groups such as fluoroalkyl groups.

Exemplary energetic polymers include nitrocellulose, azidocellulose, polysulfide, polyurethane, a fluoropolymer combined with nano particles of combusting metal fuels, polybutadiene; polyglycidyl nitrate such as polyGLYN, butanetriol trinitrate, glycidyl azide polymer (GAP), for example, linear or branched GAP, GAP diol, or GAP triol, poly[3-nitratomethyl-3-methyl oxetane](polyNIMMO), poly(3,3-bis-(azidomethyl)oxetane (polyBAMO) and poly (3-azidomethyl-3-methyl oxetane) (polyAMMO), polyvinylnitrate, polynitrophenylene, nitramine polyethers, or a combination comprising at least one of the foregoing.

The reactive multi-layer foil can comprise aluminum layers and nickel layers. The reactive multi-layer foil can also comprise titanium layers and boron carbide layers. In specific embodiments, the reactive multi-layer foil includes alternating aluminum and nickel layers.

The signal to trigger the d-o-d material in the embodiment of FIG. 3 may be electrical for example and supplied through line 52, which may extend to surface or other remote source of information, instructions, and/or power. The signal may also be acoustic, optic, seismic, RF, etc. in embodiments that also supply an energy source such as a battery for example, not shown) to receive the signal and initiate the d-o-d material is provided locally to sub 10. Upon disappearance of the inhibitor 50, there is no longer an impediment to the breaker housing 22 moving and accordingly exposing the hard point 26. The sub of FIG. 3 then operates as do the foregoing embodiments.

Figure 4:
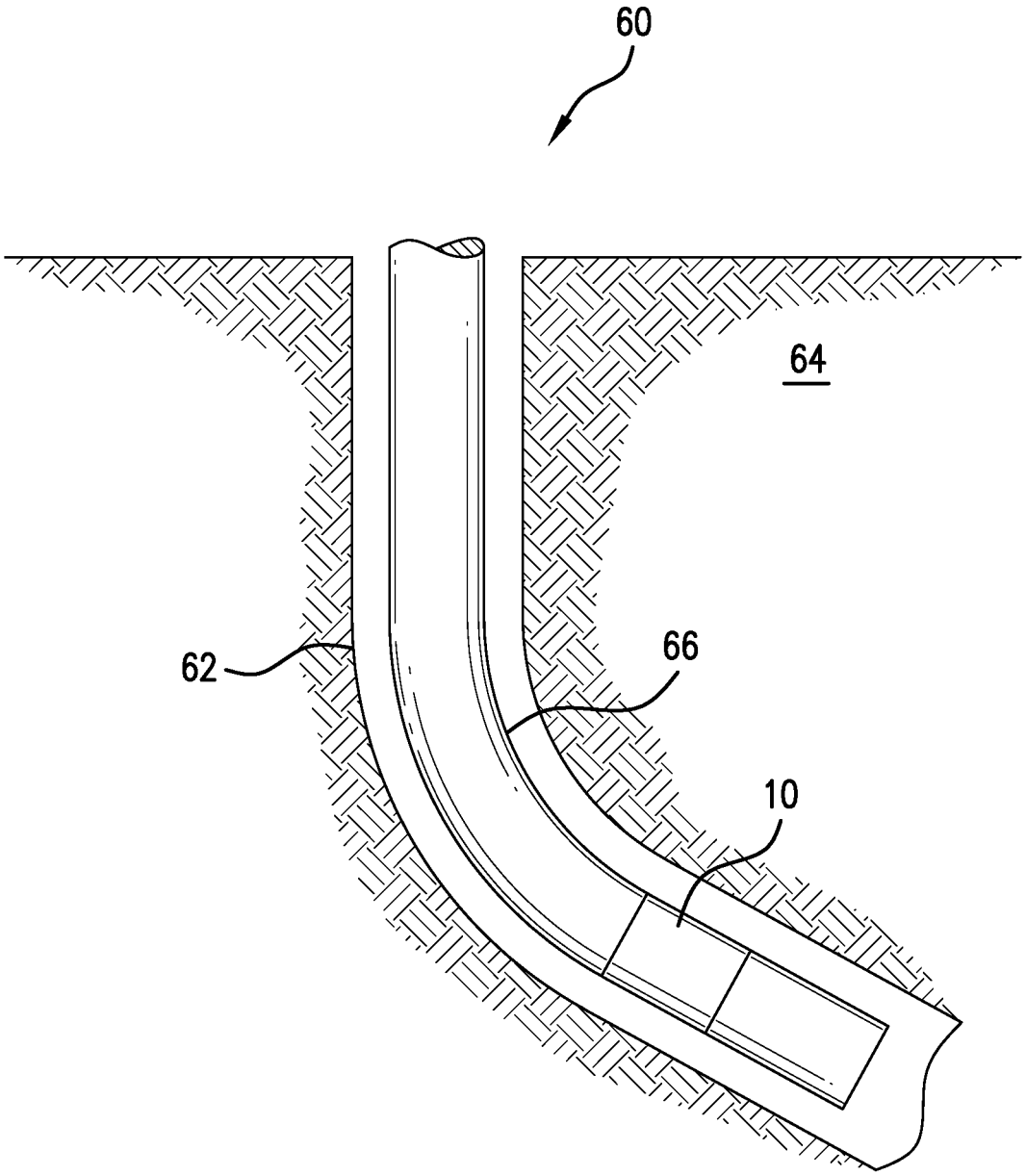
FIG. 4 is a view of a borehole system including a frangible disk sub as disclosed herein.

Referring to FIG. 4, a borehole system 60 is illustrated. The system 60 comprises a borehole 62 in a subsurface formation 64. A string 66 is disposed within the borehole 62. The frangible disk sub 10 is disposed within or as a part of the string 66.

Set forth below are some embodiments of the foregoing disclosure:

Embodiment 1: A frangible disc sub including a sub housing, a disk carrier movably disposed in the housing, a frangible disk sealedly disposed in the carrier, a breaker mechanism movably disposed in the sub housing from an inactive position to an active position, the breaker mechanism including a breaker housing movable within the sub housing, and a breaker concealed within the breaker housing, and a breaker housing movement inhibitor disposed to inhibit movement of the breaker mechanism relative to the housing.

Embodiment 2: The sub as in any prior embodiment, wherein the housing further includes a breaker stop.

Embodiment 3: The sub as in any prior embodiment, wherein the stop is interactive with the breaker when the breaker housing moves relative to the housing.

Embodiment 4: The sub as in any prior embodiment, wherein the stop when in contact with the breaker prevents breaker movement while breaker housing movement continues, thereby exposing a hard point of the breaker.

Embodiment 5: The sub as in any prior embodiment, wherein the breaker housing movement inhibitor is a crush sleeve.

Embodiment 6: The sub as in any prior embodiment, wherein the breaker housing movement inhibitor is a friction configuration.

Embodiment 7: The sub as in any prior embodiment, wherein the friction configuration includes a biaser.

Embodiment 8: The sub as in any prior embodiment, wherein the biaser is in frictional contact with a sleeve.

Embodiment 9: The sub as in any prior embodiment, wherein the breaker housing movement inhibitor comprises a disappear-on-demand material.

Embodiment 10: A method for rupturing a frangible disk in a disk sub as in any prior embodiment including pressuring the disk to exceed a threshold pressure, moving the disk, carrier and breaker mechanism relative to the housing, causing the breaker to contact the stop, exposing a hard point of the breaker, and driving the disk into the hard point.

Embodiment 11: The method as in any prior embodiment further including upon exceeding the threshold pressure, causing the breaker housing movement inhibitor to allow movement of the breaker housing.

Embodiment 12: The method as in any prior embodiment wherein the causing is by crushing.

Embodiment 13: The method as in any prior embodiment wherein the causing is by sliding.

Embodiment 14: The method as in any prior embodiment wherein the sliding includes overcoming a resistive force from a biaser.

Embodiment 15: The method as in any prior embodiment wherein the causing is by disappearance or degradation of the inhibitor.

Embodiment 16: A borehole system including a borehole in a subsurface formation, a string in the borehole, and a frangible disk sub as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frangible disc sub comprising:
a sub housing;
a disk carrier movably disposed in the sub housing;
a frangible disk sealedly disposed in the carrier;
a breaker mechanism movably disposed in the sub housing from an inactive position to an active position, the breaker mechanism comprising:
a breaker housing movable within the sub housing; and
a breaker concealed within the breaker housing; and
a breaker housing movement inhibitor disposed to inhibit movement of the breaker mechanism relative to the sub housing, wherein the breaker housing movement inhibitor is a crush sleeve.

2. The sub as claimed in claim 1, wherein the sub housing further includes a breaker stop.

3. The sub as claimed in claim 2, wherein the stop is interactive with the breaker when the breaker housing moves relative to the sub housing.

4. The sub as claimed in claim 1, wherein the stop when in contact with the breaker prevents breaker movement while breaker housing movement continues, thereby exposing a hard point of the breaker.

5. A borehole system comprising:
a borehole in a subsurface formation;
a string in the borehole; and
a frangible disk sub as claimed in claim 1 disposed within or as a part of the string.

6. A frangible disc sub comprising:
a sub housing;
a disk carrier movably disposed in the sub housing;
a frangible disk sealedly disposed in the carrier;
a breaker mechanism movably disposed in the sub housing from an inactive position to an active position, the breaker mechanism comprising:
a breaker housing movable within the sub housing; and
a breaker concealed within the breaker housing; and
a breaker housing movement inhibitor disposed to inhibit movement of the breaker mechanism relative to the sub housing, wherein the breaker housing movement inhibitor is a friction configuration.

7. The sub as claimed in claim 6, wherein the friction configuration includes a biaser.

8. The sub as claimed in claim 7, wherein the biaser is in frictional contact with a sleeve.

9. The sub as claimed in claim 6, wherein the sub housing further includes a breaker stop.

10. The sub as claimed in claim 9, wherein the stop is interactive with the breaker when the breaker housing moves relative to the sub housing.

11. The sub as claimed in claim 6, wherein the stop when in contact with the breaker prevents breaker movement while breaker housing movement continues, thereby exposing a hard point of the breaker.

12. A borehole system comprising:
a borehole in a subsurface formation;
a string in the borehole; and
a frangible disk sub as claimed in claim 6 disposed within or as a part of the string.

13. A frangible disc sub comprising:
a sub housing;
a disk carrier movably disposed in the sub housing;
a frangible disk sealedly disposed in the carrier;
a breaker mechanism movably disposed in the sub housing from an inactive position to an active position, the breaker mechanism comprising:
a breaker housing movable within the sub housing; and
a breaker concealed within the breaker housing; and
a breaker housing movement inhibitor disposed to inhibit movement of the breaker mechanism relative to the sub housing, wherein the breaker housing movement inhibitor comprises a disappear-on-demand material.

14. The sub as claimed in claim 13, wherein the sub housing further includes a breaker stop.

15. The sub as claimed in claim 14, wherein the stop is interactive with the breaker when the breaker housing moves relative to the sub housing.

16. The sub as claimed in claim 13, wherein the stop when in contact with the breaker prevents breaker movement while breaker housing movement continues, thereby exposing a hard point of the breaker.

17. A borehole system comprising:

a borehole in a subsurface formation;

a string in the borehole; and a frangible disk sub as claimed in claim 13 disposed within or as a part of the string.

18. A method for rupturing a frangible disk in a disk sub comprising:

a sub housing;

a disk carrier movably disposed in the sub housing;

a frangible disk sealedly disposed in the carrier;

a breaker mechanism movably disposed in the sub housing from an inactive position to an active position, the breaker mechanism comprising:

a breaker housing movable within the sub housing; and a breaker concealed within the breaker housing; and a breaker housing movement inhibitor disposed to inhibit movement of the breaker mechanism relative to the sub housing, the method comprising:

pressuring the disk to exceed a threshold pressure;

upon exceeding the threshold pressure, causing the breaker housing movement inhibitor to allow movement of the breaker housing, wherein the causing is by crushing;

moving the disk, carrier and breaker mechanism relative to the sub housing;

causing the breaker to contact the stop;

exposing a hard point of the breaker; and driving the disk into the hard point.

19. A method for rupturing a frangible disk in a disk sub comprising:

a sub housing;

a disk carrier movably disposed in the s housing;

a frangible disk sealedly disposed in the carrier;

a breaker mechanism movably disposed in the sub housing from an inactive position to an active position, the breaker mechanism comprising:

a breaker housing movable within the sub housing; and a breaker concealed within the breaker housing; and a breaker housing movement inhibitor disposed to inhibit movement of the breaker mechanism relative to the sub housing, the method comprising:

pressuring the disk to exceed a threshold pressure;

upon exceeding the threshold pressure, causing the breaker housing movement inhibitor to allow movement of the breaker housing, wherein the causing is by sliding, which includes overcoming a resistive force from a biaser;

moving the disk, carrier and breaker mechanism relative to the sub housing;

causing the breaker to contact the stop;

exposing a hard point of the breaker; and driving the disk into the hard point.

20. A method for rupturing a frangible disk in a disk sub comprising:

a sub housing;

a disk carrier movably disposed in the sub housing;

a frangible disk sealedly disposed in the carrier;

a breaker mechanism movably disposed in the sub housing from an inactive position to an active position, the breaker mechanism comprising:

a breaker housing movable within the sub housing; and a breaker concealed within the breaker housing; and a breaker housing movement inhibitor disposed to inhibit movement of the breaker mechanism relative to the sub housing, the method comprising:

pressuring the disk to exceed a threshold pressure;

upon exceeding the threshold pressure, causing the breaker housing movement inhibitor to allow movement of the breaker housing, wherein the causing is by disappearance or degradation of the inhibitor;

moving the disk, carrier and breaker mechanism relative to the sub housing;

causing the breaker to contact the stop;

exposing a hard point of the breaker; and driving the disk into the hard point.

* * * * *